US011486258B2

(12) United States Patent
Pöhler et al.

(10) Patent No.: US 11,486,258 B2
(45) Date of Patent: Nov. 1, 2022

(54) BLADE OF A TURBO MACHINE

(71) Applicant: MAN Energy Solutions SE, Augsburg (DE)

(72) Inventors: Thorsten Pöhler, Dinslaken (DE); Dirk Frank, Voerde (DE)

(73) Assignee: MAN ENERGY SOLUTIONS SE, Augsburg (DE)

( * ) Notice: Subject to any disclaimer, the term of this patent is extended or adjusted under 35 U.S.C. 154(b) by 0 days.

(21) Appl. No.: 17/029,411

(22) Filed: Sep. 23, 2020

(65) Prior Publication Data

US 2021/0087937 A1 Mar. 25, 2021

(30) Foreign Application Priority Data

Sep. 25, 2019 (DE) ..... 10 2019 125 779.4

(51) Int. Cl.
*F01D 5/00* (2006.01)
*F01D 5/18* (2006.01)

(52) U.S. Cl.
CPC ..... *F01D 5/187* (2013.01); *F05D 2240/303* (2013.01); *F05D 2250/90* (2013.01); *F05D 2260/20* (2013.01)

(58) Field of Classification Search
CPC ... F01D 5/18; F01D 5/147; F01D 9/02; F01D 9/023; F05D 2240/303; F05D 2250/90;
(Continued)

(56) References Cited

U.S. PATENT DOCUMENTS 3,045,965 A * 7/1962 Bowmer ..... F01D 5/187 416/97 R
3,219,123 A * 11/1965 Stocker ..... B29C 70/30 416/230

(Continued)

FOREIGN PATENT DOCUMENTS

EP 2374997 A2 10/2011
JP 2004-132218 4/2004
WO WO 2019/040272 2/2019

OTHER PUBLICATIONS

Search Report dated Jan. 13, 2021 issued in European Patent Application No. EP 2019 5435.1.

(Continued)

*Primary Examiner* — Phutthiwat Wongwian
*Assistant Examiner* — Sherman D Manley
(74) *Attorney, Agent, or Firm* — Cozen O'Connor

(57) ABSTRACT

A blade of a turbo machine, having a blade leaf, with a flow leading edge, a flow trailing edge, and flow conducting surfaces, and a cooling passage integrated in the blade leaf. In the region of the blade leaf cooling passage portions extend substantially in the radial direction. Adjacent cooling passage portions merge into one another via a diversion passage portion having a material web extending between the adjacent cooling passage portions. The respective material web ends in the region of the respective diversion passage portion. The respective material web has a defined axial width between the respective adjacent cooling passage portions and the respective material web in the region of the respective diversion passage portion has a material thickening enlarging the axial width by at least 20%.

16 Claims, 4 Drawing Sheets

(58) Field of Classification Search
CPC ..... F05D 2250/185; F05D 2250/00; F05D 2250/70; F05D 2250/73; F05D 2260/20; F02C 7/18
See application file for complete search history.

(56) References Cited

U.S. PATENT DOCUMENTS 4,474,532 A * 10/1984 Pazder ..... F01D 5/187 415/115
5,073,086 A * 12/1991 Cooper ..... F01D 5/187 416/97 R
5,626,462 A * 5/1997 Jackson ..... C23C 26/02 416/97 R
5,738,490 A * 4/1998 Pizzi ..... F01D 11/005 415/173.1
6,132,173 A * 10/2000 Tomita ..... F01D 5/187 415/114
6,176,677 B1 * 1/2001 Chevrefils ..... F01D 5/3007 415/115
6,257,830 B1 * 7/2001 Matsuura ..... F01D 5/147 415/115
6,257,831 B1 * 7/2001 Papple ..... B22C 9/10 416/97 R
6,280,140 B1 * 8/2001 Soechting ..... F01D 5/184 416/97 R
6,347,923 B1 * 2/2002 Semmler ..... F01D 5/187 416/97 R
6,508,620 B2 * 1/2003 Sreekanth ..... F01D 5/187 415/115
6,595,750 B2 * 7/2003 Parneix ..... F01D 25/12 416/97 R
6,832,893 B2 * 12/2004 Chevrefils ..... F01D 5/081 416/193 A
6,939,102 B2 * 9/2005 Liang ..... F01D 5/188 415/115
6,988,872 B2 * 1/2006 Soechting ..... F01D 5/186 415/115
7,118,337 B2 * 10/2006 Liang ..... F01D 5/187 416/97 R
7,137,780 B2 * 11/2006 Liang ..... F01D 5/187 416/97 R
7,300,250 B2 * 11/2007 Papple ..... F01D 5/187 416/97 R
7,303,376 B2 * 12/2007 Liang ..... F01D 5/187 416/233
7,357,623 B2 * 4/2008 Leghzaouni ..... F01D 5/187 416/97 R
7,427,188 B2 * 9/2008 Neuhoff ..... F01D 5/187 416/97 R
7,431,562 B2 * 10/2008 Hooper ..... F01D 5/20 416/97 R
7,435,053 B2 * 10/2008 Liang ..... F01D 5/187 416/97 R
7,473,073 B1 * 1/2009 Liang ..... F01D 25/12 415/173.5
7,527,474 B1 * 5/2009 Liang ..... F01D 5/189 416/97 R
7,527,475 B1 * 5/2009 Liang ..... F01D 5/187 416/97 R
7,547,190 B1 * 6/2009 Liang ..... F01D 5/188 416/97 R
7,547,191 B2 * 6/2009 Liang ..... F01D 5/187 416/97 R
7,568,887 B1 * 8/2009 Liang ..... F01D 5/187 416/97 R
7,584,538 B2 * 9/2009 Lee ..... F01D 5/20 29/889.71
7,600,966 B2 * 10/2009 Devore ..... F01D 5/186 415/115
7,625,179 B2 * 12/2009 Cunha ..... F01D 5/187 416/97 R
7,645,122 B1 * 1/2010 Liang ..... F01D 5/187 416/97 R
8,052,389 B2 * 11/2011 Kopmels ..... F01D 5/18 416/233
9,966,729 B2 * 5/2018 Yabe ..... H01S 5/405
10,544,686 B2 * 1/2020 Zemitis ..... F01D 5/187
10,563,519 B2 * 2/2020 Webster ..... F01D 9/041
10,648,353 B2 * 5/2020 Aggarwala ..... F01D 11/006
10,774,655 B2 * 9/2020 Spangler ..... F01D 25/12
10,975,704 B2 * 4/2021 Webster ..... F01D 5/186
10,982,551 B1 * 4/2021 Atkins ..... F01D 5/30
11,187,085 B2 * 11/2021 Zemitis ..... F01D 5/187
11,255,196 B2 * 2/2022 Freno ..... F01D 5/18
11,408,289 B2 * 8/2022 Pöhler ..... F01D 5/18
2001/0016163 A1 * 8/2001 Tomita ..... F01D 5/187 416/193 A
2003/0059577 A1 * 3/2003 Morrison ..... B32B 3/18 428/188
2006/0280606 A1 * 12/2006 Busbey ..... F01D 5/187 416/97 R
2007/0020100 A1 1/2007 Beeck et al.
2007/0104576 A1 * 5/2007 Cunha ..... F01D 5/14 416/97 R
2007/0140851 A1 * 6/2007 Hooper ..... F01D 5/187 416/97 R
2007/0166161 A1 * 7/2007 Devore ..... F01D 5/189 416/97 R
2007/0286729 A1 * 12/2007 Kopmels ..... F01D 5/188 416/97 R
2009/0274549 A1 * 11/2009 Mitchell ..... F01D 5/186 415/115
2010/0034662 A1 * 2/2010 Jendrix ..... B22C 9/10 416/97 R
2010/0047078 A1 * 2/2010 Townes ..... F01D 5/187 416/97 R
2011/0243717 A1 * 10/2011 Gleiner ..... F01D 5/187 415/177
2014/0301859 A1 * 10/2014 Hancock ..... B29C 70/865 156/60
2014/0322025 A1 * 10/2014 Barnhart ..... F03D 1/0675 416/241 R
2015/0110639 A1 * 4/2015 Herzlinger ..... F01D 5/18 416/96 R
2016/0237833 A1 * 8/2016 Tsypkaykin ..... F01D 5/081
2016/0312620 A1 * 10/2016 Diamond ..... F01D 5/18
2017/0254207 A1 * 9/2017 Schetzel ..... F01D 5/187
2018/0214935 A1 * 8/2018 Cendrowicz ..... B22C 21/14
2019/0211693 A1 7/2019 Rollinger et al.
2020/0318485 A1 * 10/2020 Pöhler ..... F01D 5/081

OTHER PUBLICATIONS

Office Action dated Oct. 25, 2021 issued in German Patent Application No. 10 2019 125 779.4.

* cited by examiner

BLADE OF A TURBO MACHINE

BACKGROUND OF INVENTION

1. Field of the Invention

The invention relates to a blade of a turbo machine.

2. Description of Related Art

Turbo machines, such as turbines or compressors, comprise stator-side assemblies and rotor-side assemblies. The rotor-side assemblies of a turbo machine include the so-called turbo machine rotor, which comprises a hub body and moving blades which, originating from the hub body, extend radially to the outside. The stator-side assemblies include so-called guide blades.

A moving blade and a guide blade of a turbo machine comprises a flow-conducting blade leaf. The blade leaf of the respective blade has a flow leading edge, a flow trailing edge, and flow conducting surfaces for a process medium extending between the flow leading edge and the flow trailing edge, which are also referred to as suction side and pressure side. Furthermore, a moving blade comprises a blade root, via which the moving blade can be fastened in the hub body of the turbo machine. The blade root is typically formed fir tree-like with at least two projections which, seen in the radial direction of the moving blade, are spaced apart from one another. A guide blade can also comprise a blade root in order to fasten the guide blade in particular to a stator-side housing. A moving blade also comprises a so-called inner shroud which, seen in the radial direction of the moving blade, is arranged between the blade leaf and the blade root. If required, an outer shroud can also follow the moving blade radially outside. Guide blades can also comprise shrouds.

In particular in the region of turbines, in which a hot process medium flows via the turbo machine, blades are employed in which a cooling passage is integrated. Here, the cooling passage extends at least over the blade leaf of the respective blade.

SUMMARY OF THE INVENTION

Although cooled blades of turbo machines with a cooling passage, that is integrated in the blade, are already generally known, there is a need for further improving the cooling of a blade, namely with high strength of the blade at the same time.

One aspect of the present invention is a new type of blade of a turbo machine which, despite cooling passage, has a high strength.

The blade according to one aspect of the invention comprises a blade leaf, which comprises a flow leading edge, a flow trailing edge and flow conducting surfaces for a process medium extending between the flow leading edge and the flow trailing edge. Furthermore, the moving blade according to one aspect of the invention comprises a cooling passage for a cooling medium that is integrated in the blade leaf, wherein in the region of the blade leaf cooling passage portions each extend substantially in the radial direction, and wherein adjacent cooling passage portions each merge into one another via a diversion passage portion. Furthermore, the moving blade according to one aspect of the invention comprises a material web extending between the adjacent cooling passage portions, wherein the respective material web ends in the region of the respective diversion passage portion, wherein the respective material web between the respective adjacent cooling passage portions has a defined axial width, and wherein the respective material web in the region of the respective diversion passage portion, enlarging the axial width by at least 20%, has a material thickening. With high strength, the blade is effectively coolable.

Preferentially, the respective material thickening, seen in the axial section, is formed prism-like with an axially front rounded corner that is thus facing the flow leading edge, with an axially back rounded corner thus facing away from the flow leading edge and an axially central radially outer or radially inner rounded corner which, seen in the axial direction, is arranged between these rounded corners. This serves for the effective cooling of the blade with high strength of the blade at the same time.

According to one aspect of the invention, the respective prism-like material thickening is formed, seen in the axial section, symmetrically in such a manner that the respective axially front, rounded corner and the respective axially back, rounded corner are arranged in the same radial position, and that the respective axially central, rounded corner is arranged in the axial centre between the respective axially front, rounded corner and the respective axially back, rounded corner and in the axial centre of the respective material web outside the respective material thickening. This serves for the effective cooling of the blade with high strength of the moving blade at the same time.

According to one aspect of the invention, the respective prism-like material thickness is formed, seen in the axial section, unsymmetrically in such a manner that the respective axially central, rounded corner is moved relative to the axial centre between the respective axially front, rounded corner and the respective axially back, rounded corner and relative to the axial centre of the respective material web outside the respective material thickening, axially to the front and thus in the direction of the flow leading edge. By way of this unsymmetrical version, the cooling medium flow in the region of the respective diversion passage portion can be adjusted.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

Figure 1:
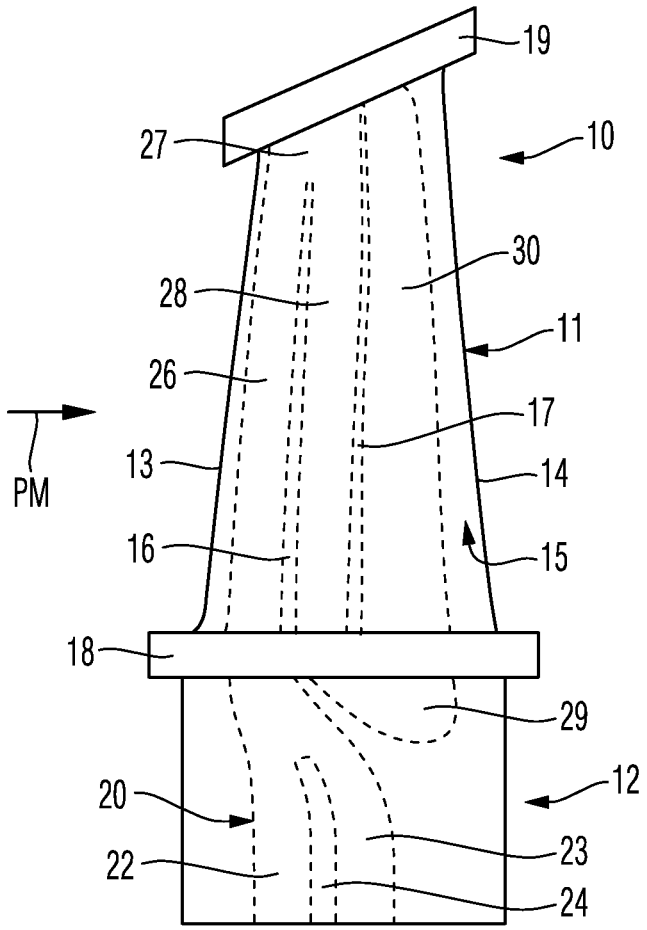
FIG. 1 is a lateral view of a blade of a turbo machine formed as moving blade.
Figure 2:
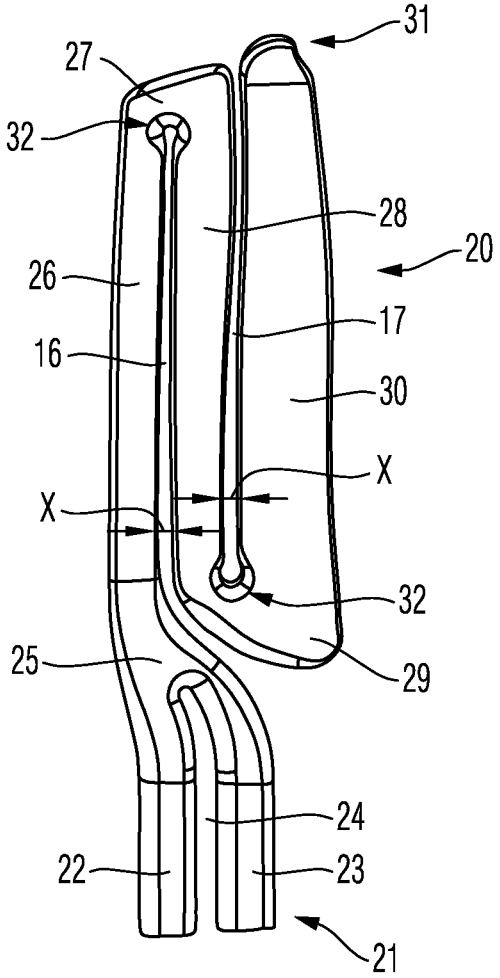
FIG. 2 are contours of a cooling passage of the blade.
Figure 3:
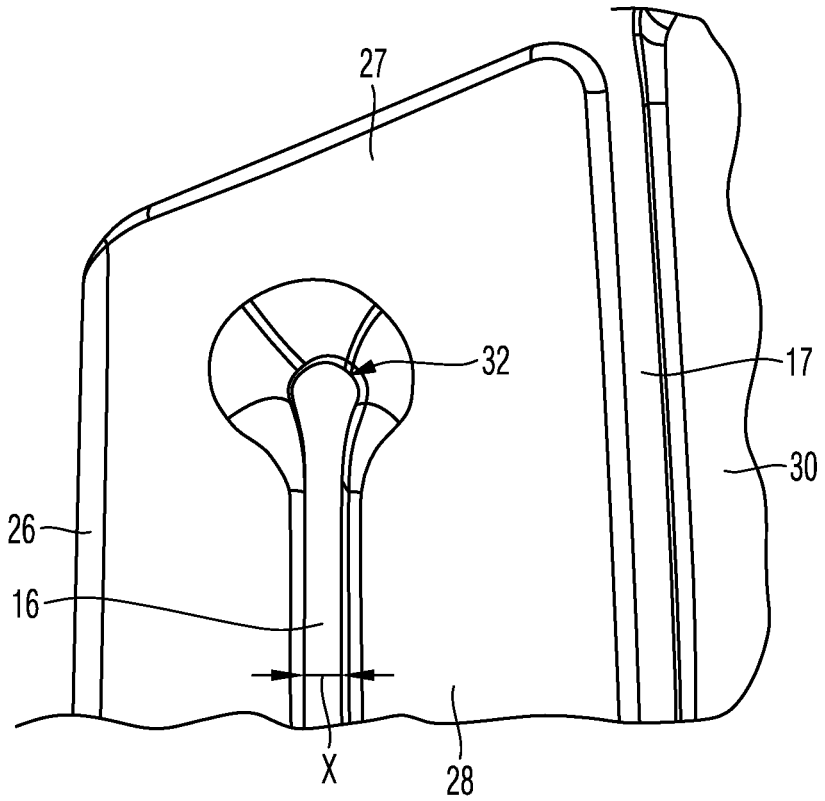
FIG. 3 is a detail of the cooling passage.
Figure 4:
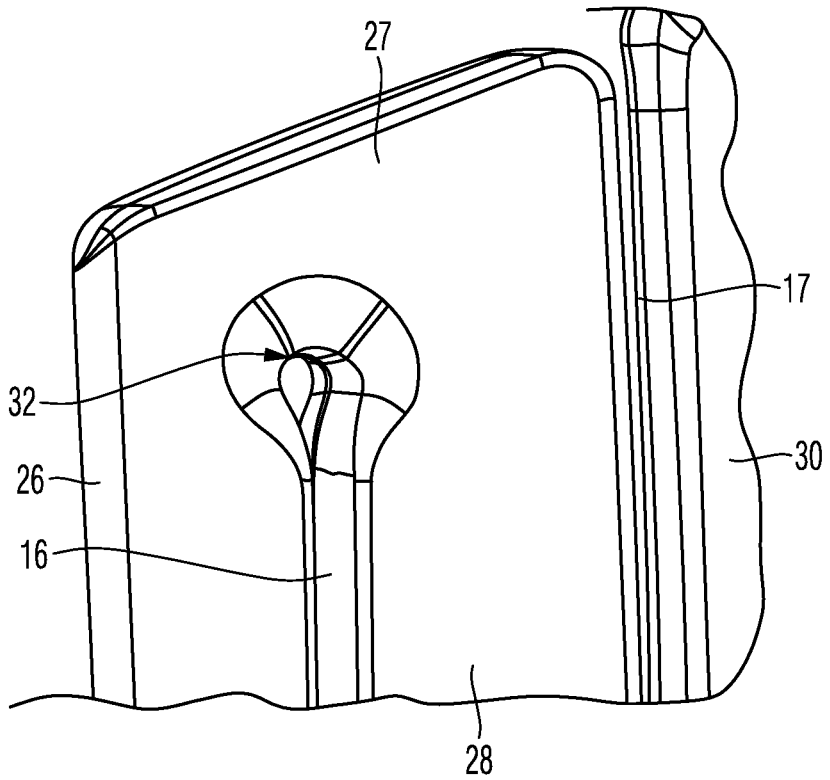
FIG. 4 is a detail of FIG. 3 in a perspective view.

The invention relates to a blade of a turbo machine.

The blade according to one aspect of the invention can be both a moving blade and also a guide blade. In the following, the invention is described for the example of a moving blade.

The exemplary moving blade 10 shown in the figures comprises a blade leaf 11 and a blade root 12. The blade leaf 11 serves for the flow conduction of a process medium PM, in particular of process gas, which flows through the turbo machine, wherein the blade leaf 11 has a flow leading edge 13, a flow trailing edge 14 and flow conduction surfaces 15 for the process medium PM extending between the flow leading edge 13 and the flow trailing edge 14. The flow conduction surfaces 15 form a suction side and a pressure side.

The blade root 12 serves for fastening the moving blade 10 in a hub body of the turbo machine which is not shown. The blade root 12 is preferentially formed pine tree-like.

Furthermore, the moving blade 10 comprises an inner shroud 18, which, seen in the radial direction of the moving blade 10, is arranged between the blade leaf 11 and the blade root 12 of the moving blade 10. The inner shroud 18 delimits radially inside a flow conduction passage for the process medium PM. In the shown exemplary embodiment, the moving blade 10, furthermore, comprises an outer shroud 19. The outer shroud 19 delimits, radially outside, the flow conduction passage for the process medium PM.

A cooling passage 20 for cooling medium KM, in particular cooling air, is integrated in the moving blade 10. In FIG. 1, contours of the cooling channel 20 are shown in dashed lines. FIGS. 2 to 5 merely show the contours of the cooling passage 20 without the actual moving blade 10. The cooling passage 20 comprises an inlet or cooling passage inlet 21, which is formed on the blade root 12 radially inside. Furthermore, the cooling passage 20 comprises an outlet or cooling passage outlet 31, which is formed on the blade leaf 11 or on the outer shroud 19 radially outside.

The inlet or cooling passage inlet 21 of the cooling passage 20 comprises a first inlet passage portion 21 and a second inlet passage portion 23. As is best evident from FIG. 1, the first inlet passage portion 21, seen in the axial direction, is positioned, based on the flow of the process medium, at the front, i.e. positioned nearer to an end of the blade root 12 which, based on the process medium flow, is positioned upstream or axially at the front, than the second inlet passage portion 23. The second inlet passage portion 23 is arranged, seen in the axial direction of the blade root 12, behind the first inlet passage portion 22.

As already explained, the blade root 12 does not serve for the process medium conduction but merely for the fastening or mounting of the moving blade 10 to the hub body. Nevertheless, the blade root 12 has two axial ends located opposite one another, namely, based on the process medium flow, an upstream or axially front end and, based on the process medium flow, a downstream or axially back end.

The first inlet passage portion 22 is arranged between the upstream or axially front end of the blade root 12 and the second inlet passage portion 23. The second inlet passage portion 23 is arranged between the first inlet passage portion 22 and the downstream or axially back end of the blade root 12. Between the two inlet passage portions 22 and 23, which in the axial direction of the blade root 12 are spaced apart from one another, a material web 24 extends. This material web 24 stiffens the moving blade 10 in the region of its blade root 12.

The first inlet passage portion 22 and the second inlet passage portion 23 of the cooling passage 20 merge into a connecting passage portion 25. The first inlet passage portion 22 and the second inlet passage portion 23 run, originating from their respective flow inlet opening, i.e. originating from radially inside, initially linearly, substantially in the radial direction to radially outside.

Following that region in which the two inlet passage portions 22, 23 run substantially linearly in the radial direction, the two inlet passage portions 22, 23 run bent or curved in the direction of the connecting passage portion 25. The curvature of the inlet passage portions 22, 23 between the regions of the same which substantially run linearly in the radial direction and the connecting passage portion 25 is directed in the direction of the upstream or axially front end of the blade root 12 or in the direction of the flow leading edge 13 of the moving blade 10.

Following the connecting passage portion 25, the cooling passage 20 extends in the region of the blade leaf 11 with a first cooling passage portion 26 of the blade leaf 11 substantially extending in the radial direction, initially to radially outside in the direction of a radially outer diversion passage portion 27, following the radially outer diversion passage portion 27 with a second cooling passage portion 28 of the blade leaf 11 substantially extending in the radial direction, to radially inside in the direction of an inner diversion passage portion 29 and following this radially inner diversion passage portion 29 with a third cooling passage portion 30 of the blade leaf 11 extending substantially in the radial direction, to radially outside in the direction of the cooling passage outlet 31. The respective adjacent cooling passage portions 26, 28 and 28, 30 are positioned in the axial direction one behind the other. The radially inner diversion passage portion 29 is arranged, seen in the radial direction, below or radially inside of the inner shroud 18. The radially outer diversion passage portion 27 can extend into the region of the outer shroud 19. The respective adjacent cooling passage portions 26, 28 and 28, 30 merge into one another via a diversion passage portion 27, 29 each. Substantially extending in the radial direction means that the respective cooling passage portion is inclined relative to the radial direction by a maximum of 30°, preferentially by a maximum of 20°.

In the region of the blade leaf 11, a first material web 16 is formed between the first cooling passage portion 26 of the blade leaf 11 and the adjacent second cooling passage portion 28 of the blade leaf 11, which substantially extends in the radial direction. Between the second cooling passage portion 28 of the blade leaf 11 and the adjacent third cooling portion 30 of the blade leaf 11, a second material web 17 extends, which also extends substantially in the radial direction. Seen in the axial direction, the first material web 16 is formed before the second material web 17. The material webs 16, 17 stiffen the blade leaf 11.

The first material web 16, which is formed between the first cooling passage portion 26 and the second cooling passage portion 28, ends radially outside in the region of the radially outer diversion passage portion 27. The second material web 17, which is formed between the second cooling passage portion 28 and the third cooling passage portion 30, ends radially inside in the region of the radially inner diversion passage portion 29.

The first material web 16 and the second material web 17 have, seen in the axial direction, a defined axial width x each. This defined axial width x of the first material web 16 can correspond to the defined axial width x of the second material web 17. The axial widths x of the two material webs 16 and 17 can also deviate from one another.

The first material web 16 and/or the second material web 17, preferentially both material webs 16 and 17, comprises or comprise a material thickening 32 in the region of the respective diversion passage portion 27, 29, which widens the axial width of the respective material web 16, 17 in the region of the respective diversion passage portion 27, 29, namely by at least 20%.

Preferentially it is provided that the first material web 16 comprises, in the region of the radially outer diversion passage portion 27 and the second material web 17 in the region of the radially inner diversion passage portion 29, an enlargement of the axial width each by between 20% and 40%, preferentially between 30% and 40%.

Figure 5:
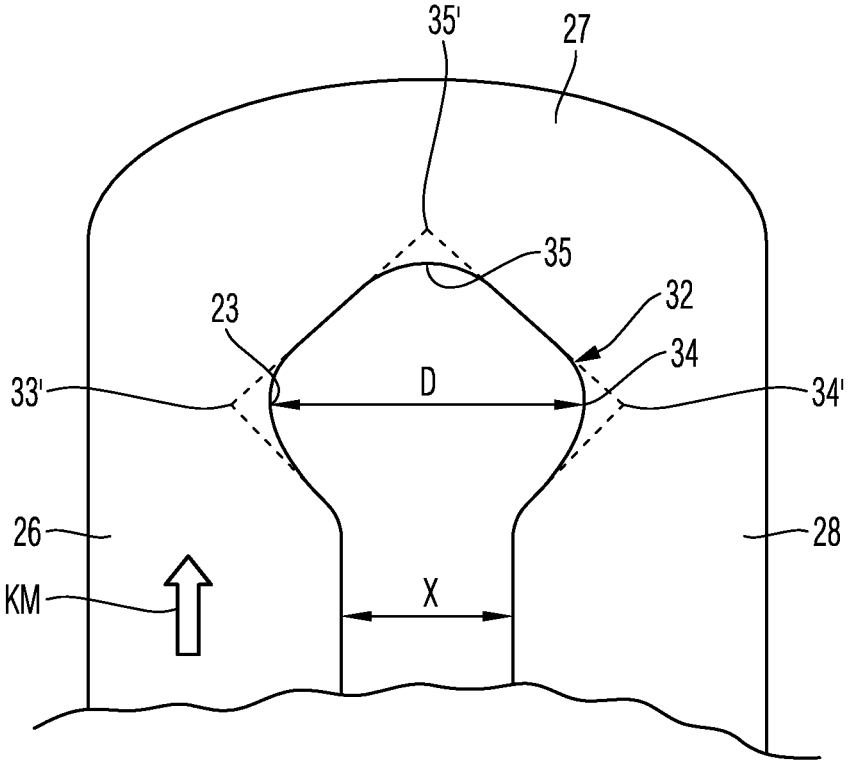
FIG. 5 is a detail of FIG. 3 with geometric quantities.

Making reference to the dimensions x and D in FIG. 5 the following applies accordingly: $0.2 \leq (D-x)/x \leq 0.4$. Preferentially the following applies: $0.3 \leq (D-x)/x \leq 0.4$. x is the defined axial width of the respective material web 32 outside the region of the material thickening 32, and D is the maximum axial width of the material thickening 32.

Seen in the axial section (see in particular FIGS. 5 and 6), the respective material thickening 32 is formed prism-like. The respective prism-like material thickening 32 has, seen in the axial section, an axially front rounded corner 33 which thus faces the flow leading edge 13 of the blade leaf 11, an axially back rounded corner 34 which thus faces away from the flow leading edge 13 of the blade leaf 11 and an axially central rounded corner 35 which seen in the axial direction is arranged between the rounded corners 33, 34, which for the material web 16 in the region of the radially outer diversion passage portion 27 is a radially outer corner 35 and for the material web 17 in the region of the radially inner diversion passage 29, a radially inner corner 35. As already explained, the material thickening 32, seen in the cross section, is embodied prism-like. The corners 33, 34 and 35 of this prism contour described above are rounded. With the reference numbers 33, 34 and 35, FIG. 5 shows the rounded corners of the prism. With the reference numbers 33', 34' and 35', the corners of the respective prism contour that are not rounded are shown.

In the exemplary embodiment of FIG. 5, the respective prism-like material thickening 32, seen in the axial section, is formed symmetrically. The axially front rounded corner 33 and the axially back rounded corner 34 are arranged in the same radial position. The axially central rounded corner 35 is arranged on the one hand in the axial centre between the axially front rounded corner 33 and the axially back rounded corner 34 and on the other hand in the axial centre of the web 16 or 17 outside the material thickening 32.

Figure 6:
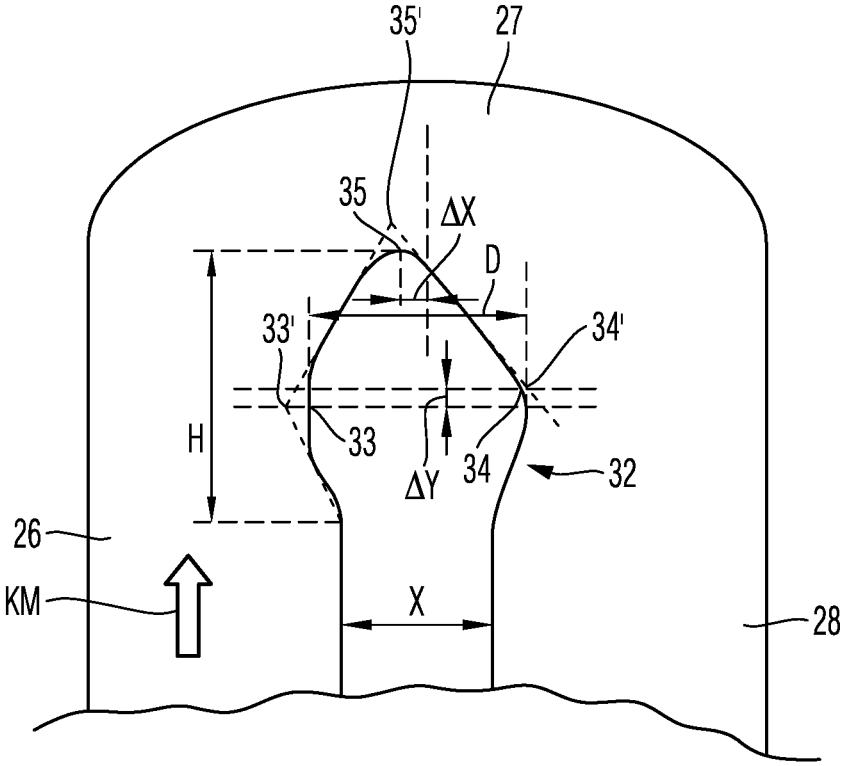
FIG. 6 is a detail with further geometric quantities.

In order to adapt or optimally adjust the flow conditions of the cooling medium in the region of the respective diversion passage portion 27, 29 it can be provided, as shown in FIG. 6, that the respective prism-like material thickening 32 of the respective web 16, 17, seen in the axial section, is formed unsymmetrically. Here, FIG. 6 illustrates a preferred unsymmetrical prism-like material thickening.

From FIG. 6 it is evident that the axially central rounded corner 35 is moved relative to the axial centre between the axially front corner 33 and the axially back corner 34 and relative to the axial centre of the respective web 16, 17 outside the material thickening 32 axially to the front and thus in the direction of the flow leading edge.

Here, the central rounded corner 35 is moved relative to the axial centre by the amount Δx towards the front in the direction of the flow leading edge 13. The amount Δx, by which the axially central rounded corner 35 is moved axially to the front in the direction of the flow leading edge 13 amounts to between 10% and 20% of the axial width x of the respective web 16, 17 outside the material thickening. Accordingly the following applies:

$$0.1 \leq \Delta x/x \leq 0.2$$

wherein x is the axial width of the web 16, 17 outside the material thickening 32, and wherein Δx is the amount by which the axially central corner 35 is moved relative to the axial centre of the web 16, 17 axially to the front.

In a preferred exemplary embodiment of an unsymmetrical configuration of the respective material thickening 32 it is provided according to FIG. 6 that seen in the axial section the axially front rounded corner 33 is offset relative to the axially back rounded corner 34 in the radial direction, namely in the region of the outer diversion passage portion 27 for the material web 16 to radially inside and in the region of the radially inner diversion passage portion 29 to radially outside.

This radial offset Δy between the rounded corners 33, 34 of the respective prism-like material thickening 32 preferentially amounts to between 10% and 20% of the radial height H of the respective material thickening. Accordingly the following applies:

$$0.1 \leq \Delta y/H \leq 0.2$$

wherein Δy is the radial offset between the corners 33, 34 and wherein H is the respective radial height of the material thickening.

Seen perpendicularly to the axial direction and seen perpendicularly to the radial direction, i.e. in a direction running perpendicularly to the drawing plane of FIGS. 5 and 6, the respective prism-like material thickening 32 can have a constant thickness. However, the thickness of the same can also vary in this direction. Here it is then provided in particular that the thickness of the respective prism-like material thickening 32 in the region of the flow conducting surfaces 15 is thicker than between the same.

With the blade 10 according to the invention, a flow conduction of the cooling medium in the region of the diversion passage portions 27, 29 can be configured optimally in order to thus make possible as effective as possible a cooling of the moving blade 10. Furthermore, the invention provides a good strength of the blade 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A blade of a turbo machine, comprising:

a blade root configured to fasten to a hub body of the turbo machine;

a blade leaf, wherein the blade root is separated from the blade leaf by an inner shroud, wherein the blade leaf comprises:

a flow leading edge;

a flow trailing edge; and flow conduction surfaces for a process medium extending between the flow leading edge and the flow trailing edge;

one continuous cooling passage integrated in the blade leaf and the blade root for a cooling medium, comprising:

an inlet at a first fluidic end of the one continuous cooling passage is formed radially inside on the blade root;

an outlet at a second fluidic end of the one continuous cooling passage radially outside on the blade leaf or on an outer shroud;

wherein in a region of the blade leaf radial cooling passage portions each extend substantially in a radial direction a length of the blade leaf, wherein adjacent radial cooling passage portions merge into one another via a respective diversion passage portion;

a material web extending between the adjacent radial cooling passage portions in the blade leaf, wherein the respective material web ends in a region of the respective diversion passage portion, wherein the respective material web between the respect the adjacent radial cooling passage portions has as defined axial width, wherein the respective material web in the region of the respective diversion passage portion has a material thickening enlarging an axial width by at least 20%.

2. The blade according to claim 1, wherein the respective material web in the region of the respective diversion passage portion has an enlargement of the axial width by between 20% and 40%.

3. The blade according to claim 2, wherein the respective material web in the region of the respective diversion passage portion has an enlargement of the axial width by between 30% and 40%.

4. The blade according to claim 1, wherein seen in an axial section the respective material thickening is formed prism-like with an axially front rounded corner that is thus facing the flow leading edge, with an axially back rounded corner thus facing away from the flow leading edge, and an axially central, radially outer or radially inner rounded corner arranged seen in an axial direction between these rounded corners.

5. The blade according to claim 4, wherein seen in the axial section the respective prism-like material thickening is formed symmetrically such that a respective axially front corner and a respective axially back corner are arranged in a same radial position, and in that a respective axially central corner is arranged in an axial centre between the respective axially front corner and the respective axially back corner and in an axial centre of the respective material web outside the material thickening.

6. The blade according to claim 4, wherein in the axial section, the respective prism-like material thickening is formed unsymmetrically such that the respective axially central corner is moved, relative to an axial centre between the respective axially front corner and the respective axially back corner and relative to the axial centre of the respective material web outside the material thickening, axially to the front and thus in a direction of the flow leading edge.

7. The blade according to claim 6, wherein an amount by which the respective axially central corner is shifted axially to the front to between 10% and 20% of the axial width of the respective web outside the material thickening.

8. The blade according to claim 6, wherein in the axial section the respective prism-like material thickening is formed unsymmetrically such that the respective axially front corner is radially offset relative to the respective axially back corner in the radial direction.

9. The blade according to claim 8, wherein in the region of a radially outer diversion passage portion the respective axially front corner is moved radially to the inside relative to the respective axially back corner.

10. The blade according to claim 8, wherein in the region of a radially inner diversion passage portion the respective axially front corner is offset relative to the respective axially back corner radially to the outside.

11. The blade according to claim 8, wherein a radial offset between the axially front corner relative to the axially back corner is between 10% and 20% of a radial height of the respective material thickening.

12. The blade according to claim 1, further comprising:

wherein in the region of the blade leaf a first cooling passage portion of the cooling passage initially extends to radially outside in the direction of a radially outer diversion passage portion, following this a second cooling passage portion to radially inside in the direction of a radially inner diversion passage portion and following this a third cooling passage portion to radially outside in the direction of the outlet of the cooling passage, a first material web extends between the first cooling passage portion and the second cooling passage portion and between the second cooling passage portion and the third cooling passage portion a second material web extends, wherein first material web ends in the region of the radially outer diversion passage portion and the second material web in the region of the radially inner diversion passage portion, wherein the first material web and the second material web has a defined axial width between the respective cooling passage portions, and wherein the first material web and/or the second material web, in the region of the respective diversion passage portion, has the material thickening enlarging the axial width by at least 20%.

13. The blade according to claim 1, wherein the blade leaf extends radially outward beyond an inner shroud.

14. The blade according to claim 13, wherein the blade rood extends radially inward from the inner shroud.

15. The blade according to claim 12, wherein at least one diversion passage is radially inside the inner shroud and the respective material web defining this diversion passage does not extend into the blade root.

16. The blade according to claim 1, wherein the inlet at the first fluidic end of the one continuous cooling passage comprises:

a first inlet passage portion arranged in the blade root;

a second inlet passage portion in the blade root that is axially offset from the first inlet portion; and a connecting passage portion in which the first inlet passage portion joins the second inlet passage portion.

* * * * *